US007121106B2

(12) United States Patent
Jung et al.

(10) Patent No.: US 7,121,106 B2
(45) Date of Patent: Oct. 17, 2006

(54) PIPE STRUCTURE FOR OUTDOOR UNIT OF AIR CONDITIONER

(75) Inventors: In Hwa Jung, Seoul (KR); Jung Woo Lee, Seoul (KR); Seong Won Bae, Seoul (KR); Sim Won Chin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 10/914,087

(22) Filed: Aug. 10, 2004

(65) Prior Publication Data

US 2005/0172656 A1 Aug. 11, 2005

(30) Foreign Application Priority Data

Feb. 10, 2004 (KR) ..... 10-2004-0008572

(51) Int. Cl.
*F25B 13/00* (2006.01)

(52) U.S. Cl. ..... 62/324.6

(58) Field of Classification Search ..... 62/324.1–324.6
See application file for complete search history.

(56) References Cited

U.S. PATENT DOCUMENTS 5,775,120 A * 7/1998 Inazuka et al. ..... 62/259.1

* cited by examiner

*Primary Examiner*—William E. Tapolcai
(74) *Attorney, Agent, or Firm*—Greenblum & Bernstein, P.L.C.

(57) ABSTRACT

Provided is a pipe structure for an outdoor unit of an air conditioner, in which a length of an induction pipe of a compressor mounted in the outdoor unit is shorter than a connection pipe in the outdoor unit in order to decrease vibration of the outdoor unit of the air conditioner.

20 Claims, 5 Drawing Sheets

PIPE STRUCTURE FOR OUTDOOR UNIT OF AIR CONDITIONER

BACKGROUND OF THE INVENTION

1. Field of the Invention

The present invention relates to a pipe structure for an outdoor unit of an air conditioner. More particularly, the present invention relates to a pipe structure for an outdoor unit of an air conditioner, which is capable of further decreasing concentration of vibrations generated in the entire structure of the outdoor unit of the air conditioner by restraining the phenomenon that vibrations are concentrated due to resonance in a pipe to which the vibrations generated in a compressor are transferred.

2. Description of the Related Art

An air conditioner is a machine for controlling temperature and/or humidity in a system desired by a user, with circulating cool air, generated through compression, condensation, expansion and evaporation of coolant, inside the system.

This air conditioner includes an indoor unit positioned indoors, and an outdoor unit positioned outdoors to emit undesired hot or cool air. Meanwhile, the outdoor unit generally includes an outdoor heat exchanger for heat exchange, an outdoor fan for compulsively making an air channel, and a compressor for making coolant be forcibly flowed in a refrigeration cycle. In particular, the compressor is generally installed in the outdoor unit in order to improve indoor noise environments since the compressor itself generates noise in operation.

However, the outdoor unit is recently positioned nearer to the indoor space, as the indoor environment is smaller, so the noise of the outdoor unit is apt to be propagated to the indoor space. Thus, more efforts are made to decrease noise generated while the outdoor unit is operated. In particular, in case the outdoor unit and the indoor unit are positioned in the same equipment like a window-type air conditioner, such problems related to noise become more significant.

Meanwhile, the noise of the outdoor unit is classified into a noise generated while the outdoor fan is operated and a noise generated while the compressor is operated. The present invention is mainly directed to decrease the noise generated while the compressor is operated. The noise generated by the compressor is generally propagated through a pipe. Particularly, the noise is more greatly and abundantly propagated through an induction pipe, which is connected to an induction portion of the compressor and has high rigidity and great eccentricity. Furthermore, the induction pipe is relatively longer than other pipes in order to reduce a vibration transferring ability of the pipe, which however induces concentration of vibrations more seriously in the induction pipe. In particular, the vibration is far greater approximately at the center of the induction pipe due to the influence of resonance or the like. In addition, due to the concentration of vibrations in the induction pipe, fatigue of the pipe is generally accumulated, so the pipe is frequently broken down.

In addition, if a compressor which generates vibrations of various frequencies like a variable speed compressor is installed in the outdoor unit, the resonance phenomenon is further amplified by the various frequencies, thereby making the vibration problem of the induction pipe more serious. In addition, the variable speed compressor is a compressor whose revolution number is varied according to an amount of compressed coolant by the control of an inverter, and it is more and more used in these days.

SUMMARY OF THE INVENTION

Accordingly, the present invention is directed to a pipe structure for an outdoor unit of an air conditioner that substantially obviate one or more problems due to limitations and disadvantages of the related art.

An object of the invention is to provide a pipe structure for an outdoor unit of an air conditioner that can decrease noise generated in the outdoor unit. In addition, the present invention proposes a pipe structure for an outdoor unit of an air conditioner that can restrain fatigue failure of the pipe by providing suitable shape and length of the pipe of the outdoor unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a pipe structure for an outdoor unit of an air conditioner, which includes: a case; an outdoor heat exchanger and an outdoor fan mounted in the case; a compressor for compressing a coolant; a four-way valve for controlling flow of the coolant to a forward or backward direction; an outdoor connection pipe connected from the outdoor heat exchanger to the four-way valve; an indoor connection pipe connected from the four-way valve to an indoor heat exchanger; an induction pipe connected from the four-way valve to an induction portion of the compressor, the induction pipe having a length as much as 0.3 to 1 times of the sum of a length of the outdoor connection pipe and a length of the indoor connection pipe; and a discharge pipe connected from the four-way valve to a discharge portion of the compressor.

In another aspect of the present invention, there is provided a pipe structure for an outdoor unit of an air conditioner, wherein the pipe structure satisfies the following equation:

$$1.0 > \frac{C}{A+B} > 0.3$$

where A is a length of an outdoor connection pipe connected from an outdoor heat exchanger to a four-way valve, B is a length of an indoor connection pipe connected from an indoor heat exchanger to the four-way valve, and C is a length of an induction pipe connected from the four-way valve to an induction portion of a compressor.

In still another aspect of the present invention, there is also provided pipe structure for an outdoor unit of an air conditioner, which includes an inverter-controlled compressor in which vibrations are generated; an induction pipe connected from an induction portion of the compressor to a four-way valve, at least one looping being generated in the induction pipe; and a connection pipe having an outdoor connection pipe connected from the four-way valve to an outdoor heat exchanger and an indoor connection pipe connected from the four-way valve to an indoor heat exchanger, the sum of a length of the outdoor connection pipe and a length of the indoor connection pipe being longer than a length of the induction pipe in order to decrease vibrations of the induction pipe.

By using the proposed present invention, it is possible to decrease vibrations generated in pipes of the outdoor unit effectively.

In addition, vibrations generated in the induction pipe, which is a main vibration generation area of the outdoor unit, may be restricted. In particular, by reducing vibrations generated due to the effect of resonance at the center portion of the entire length of the induction pipe, fatigue of the pipe may be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, preferred embodiments to which the spirit of the present invention is applied will be described in detail with reference to the accompanying drawings.

Figure 1:
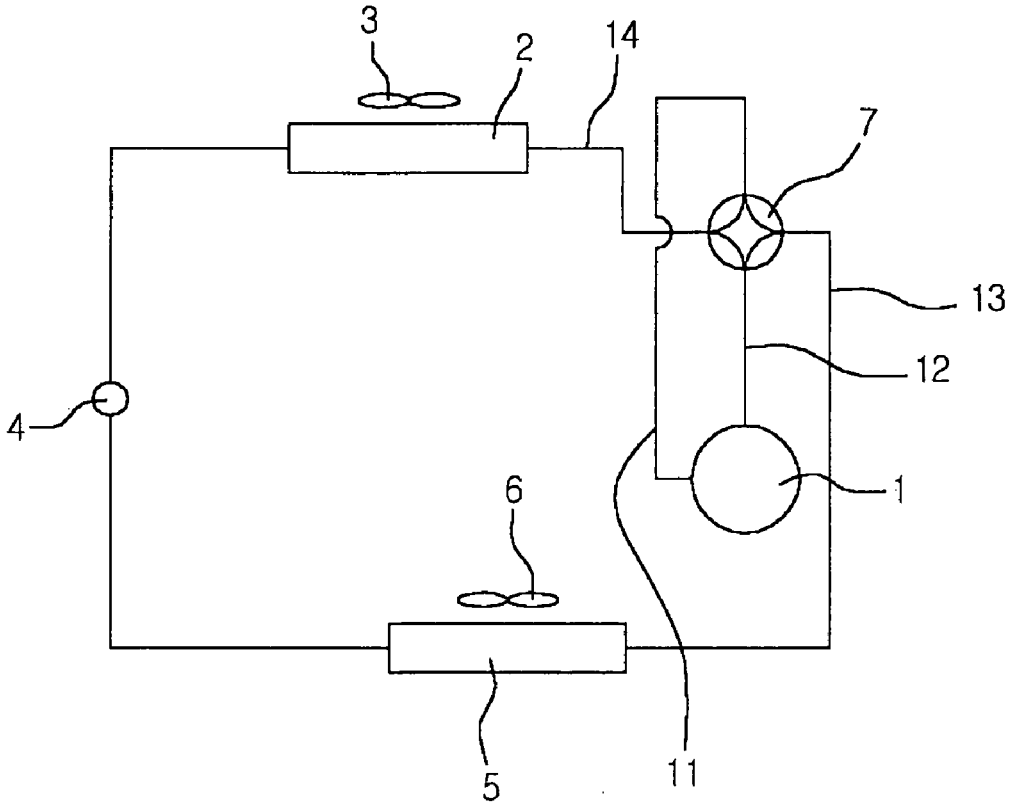
FIG. 1 is a schematic view showing a refrigeration system to which the spirit of the present invention is applied.

FIG. 1 shows a refrigeration system to which the spirit of the present invention is applied.

Referring to FIG. 1, the refrigeration system includes a compressor 1 for compressing a coolant, an outdoor heat exchanger 2 for exchanging heat outdoors, an outdoor fan 3 for forcibly making an air channel in the outdoor heat exchanger 2, an expansion valve 4 for expanding the coolant, an indoor heat exchanger 5 for exchanging heat indoors, an indoor fan 6 for forcibly making an air channel in the indoor heat exchanger 5, and a four-way valve 7 for changing flow of the coolant to a forward or backward direction in the refrigeration cycle so that the refrigeration cycle is switched to an air conditioning cycle or a heat pump. In addition, the refrigeration system further includes an induction pipe 11 connected from the four-way valve 7 to an induction portion of the compressor, a discharge pipe 12 connected from the four-way valve 7 to a discharge portion of the compressor, an indoor connection pipe 13 connected from the four-way valve 7 to a service valve 15 (see FIG. 2), and an outdoor connection pipe 14 connected from the four-way valve 7 to the outdoor heat exchanger 2.

A flowing direction of the coolant in the induction pipe 11, the discharge pipe 12, the indoor connection pipe 13 and the outdoor connection pipe 14 may be controlled by means of the four-way valve 7. That is to say, if the discharge pipe 12 is connected to the outdoor connection pipe 14 and the induction pipe 11 is connected to the indoor connection pipe 13 by the switching operation of the four-way valve 7, the refrigeration system acts as an air conditioner for cooling a room. In addition, if the discharge pipe 12 is connected to the indoor connection pipe 13 and the induction pipe 11 is connected to the outdoor connection pipe 14, the refrigeration system acts as a heat pump for heating the room.

Meanwhile, a main purpose of the present invention is to decrease noise generated in the outdoor unit. After analyzing reasons of the vibrations generated in the entire outdoor unit, particularly in the induction pipe of the outdoor unit, the inventor found that vibrations and noise of the induction pipe of the compressor are mainly dependent on the length of the induction pipe, and also vibration and shaking at the approximate center of the induction pipe are chiefly influenced on the noise of the entire pipes. In addition, it was also found that a preferable length of the induction pipe is dependent on the entire length of the induction pipe connected from the compressor to the four-way valve, to the sum of a length of the connection pipe connected from the outdoor heat exchanger to the four-way valve and a length of the connection pipe connected from the four-way valve to the service valve. The inventor herein proposes preferable correlations of such factors, and also proposes a pipe structure for the outdoor unit, which is capable of further decreasing the noise generated in the outdoor unit of the air conditioner.

Figure 2:
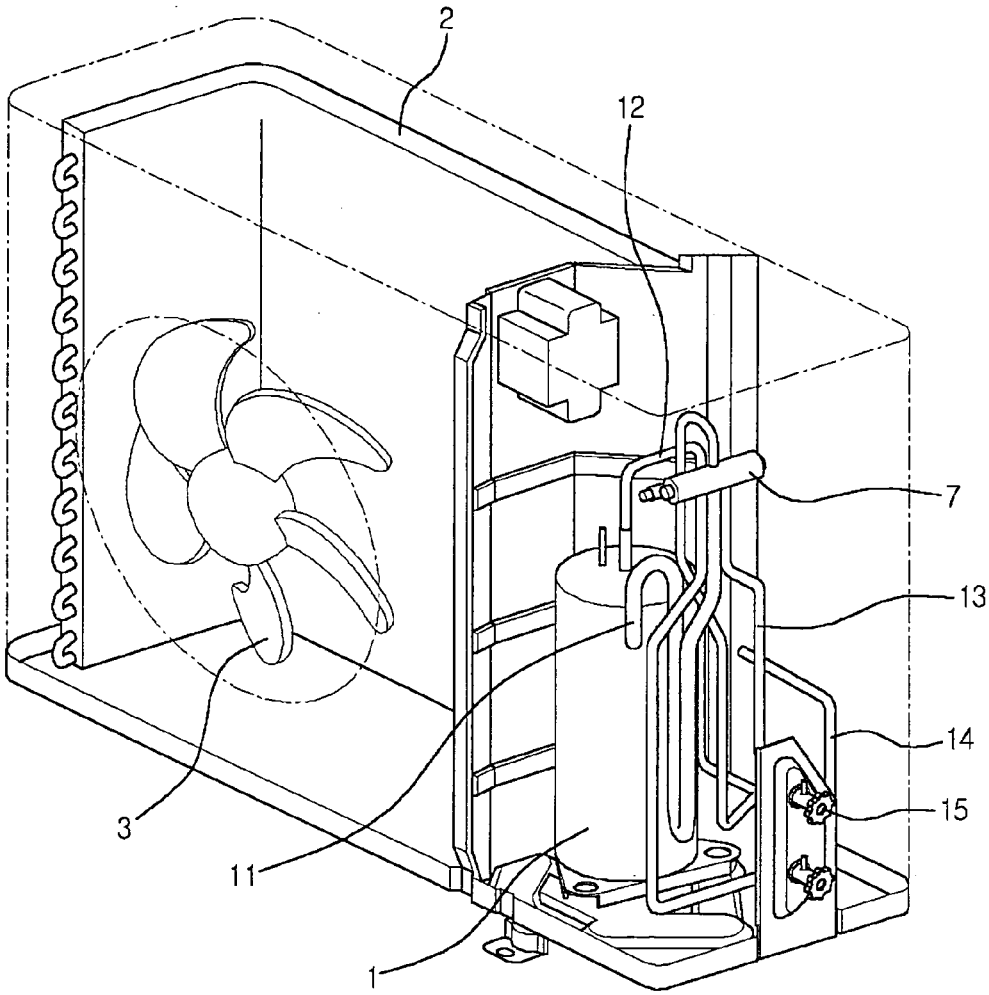
FIG. 2 is a perspective view showing an outdoor unit according to the present invention.

FIG. 2 is a perspective view showing the outdoor unit according to the present invention.

Referring to FIG. 2, it is seen that the outdoor unit includes the compressor 1, the outdoor heat exchanger 2, the outdoor fan 3, the four-way valve 7, the induction pipe 11, the discharge pipe 12, the indoor connection pipe 13 and the outdoor connection pipe 14 therein. In addition, the service valve 15 is mounted at an end portion of the indoor connection pipe 13, which is exposed out of the outdoor unit. The service valve 15 may be used for making the pipes vacuous, temporarily stopping the refrigeration system or injecting/discharging a coolant, and it is protruded out of the outdoor unit case. In addition, the induction pipe 11 is protruded laterally from an approximately upper portion of the compressor 1, then extended to a lower portion of the compressor, and then bent upward again so as to have a suitable length. The pipe is looped at the approximately upper and lower portions of the compressor as mentioned above, and thus it is possible to configure the induction pipe 11 more than a certain length. Furthermore, a bent portion of the induction pipe 11 at the lower portion is a center of the entire length of the induction pipe 11 where vibrations are concentrated. Thus, to decrease vibrations at that point is another object of the present invention.

In order to accomplish the object, an entire length of the induction pipe 11 is smaller than the sum of a length of the outdoor connection pipe 14 and a length of the indoor connection pipe 13. The reason that the entire length of the induction pipe 11 is formed shorter as mentioned above is that, as the length of the induction pipe 11 is longer, shaking of the induction pipe 11 itself is increased and thus noise and fatigue of the pipe are also increased due to the factor such as resonance though a vibration transferring ability of the induction pipe 11 is decreased. Now, correlation of the induction pipe 11, the indoor connection pipe 13 and the outdoor connection pipe 14 is described below with reference to another drawing.

Figure 3:
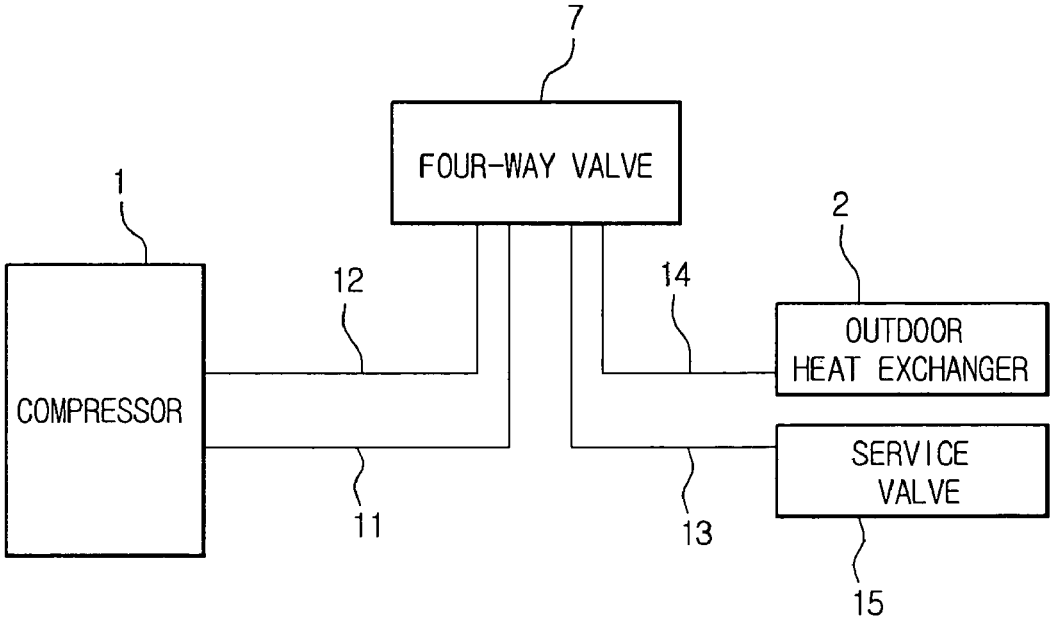
FIG. 3 is a schematic diagram showing the outdoor unit according to the present invention.

FIG. 3 is a schematic diagram showing the outdoor unit according to the present invention.

Referring to FIG. 3, with the four-way valve 7 as the nucleus, the induction pipe 11 connected to an induction portion of the compressor, the discharge pipe 12 connected to a discharge portion of the compressor, the outdoor connection pipe 14 connected to the outer heat exchanger 2, and the indoor connection pipe 13 connected to the service valve 15 are located. FIG. 3 is focused on the entire length of the pipes, disregarding bending of the pipes, which may be seen in the actual outdoor unit. Of course, it may also be deliberated that two or three dimensional bending or looping of the pipe decreases a vibration transferring ability and reduces noise generation, but the present invention proposes correlation of the entire lengths of the pipes.

Correlation of the entire lengths of the induction pipe 11, the outdoor connection pipe 14 and the indoor connection pipe 13 for accomplishing the object of the present invention is proposed as follows.

$$1.0 > P_ratio > 0.3 \qquad \text{Equation 1}$$

At this time, P_ratio=length of the induction pipe/(length of the indoor connection pipe+length of the outdoor connection pipe).

P_ratio is less than 1.0 in the equation 1. As the length of the induction pipe is longer and longer, it is expected that a vibration transferring ability through the induction pipe is decreased. However, if the induction pipe is longer, resonance is amplified due to the longer length of the induction pipe itself, thereby increasing noise and vibration. In addition, since the vibration generated in the compressor may be concentrated on the induction pipe, the induction pipe is apt to be easily broken down. P_ratio is also greater than 0.3. If the length of the induction pipe is too short relative to the length of the entire pipes, reduction of the vibration transferring ability through the induction pipe cannot be expected, and more serious vibrations are generated in other pipes, not in the induction pipe. In particular, since the induction pipe has stronger rigidity than other pipes, such problems are more amplified.

Meanwhile, the induction pipe conforming to the equation 1 may give the same effects, namely vibration reduction, for a vibration having a frequency with broad bandwidth, so it may be more suitably applied to the variable speed compressor. The variable speed compressor may be controlled by an inverter, as mentioned above.

Figure 4:
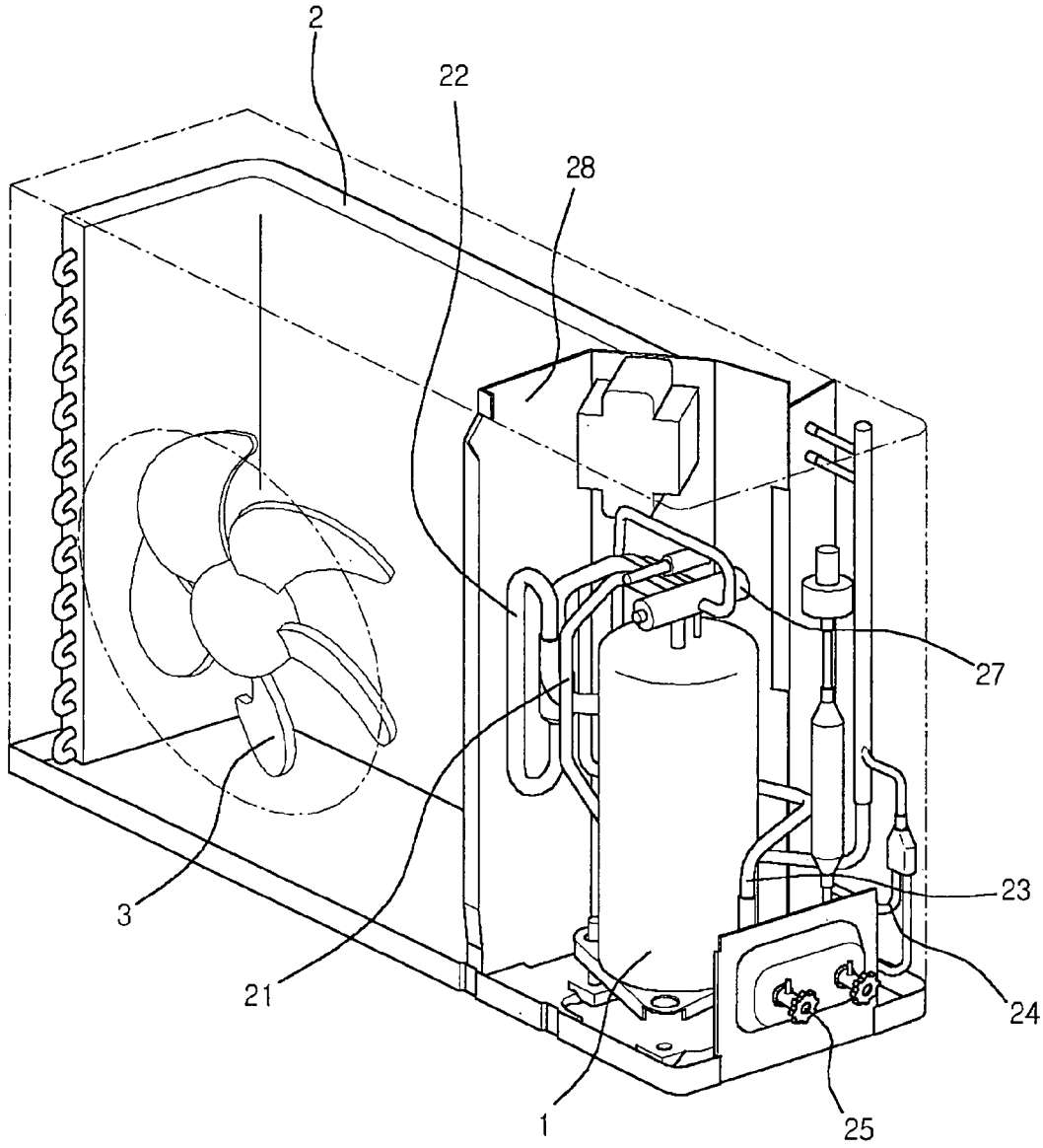
FIG. 4 is a perspective view showing an outdoor unit according to another embodiment of the present invention.

FIG. 4 shows an outdoor unit according to another embodiment of the present invention.

In the outdoor unit shown in FIG. 2, a plurality of pipes such as the induction pipe 11, the discharge pipe 12, the outdoor connection pipe 14 and the indoor connection pipe 13 exist in front of the compressor, namely between the compressor and the outdoor unit case. However in this embodiment, referring to FIG. 4, main portions of an induction pipe 21, a discharge pipe 22, an outdoor connection pipe 24 and an indoor connection pipe 23 are placed at the rear of the compressor, namely between the compressor 1 and a barrier 28. If a plurality of pipes are placed between the compressor 1 and the barrier 28, the whole size of the outdoor unit may be decreased and the outdoor unit may become more compact.

Even in this embodiment, a length of the induction pipe 21 may be suitably set by applying the relation of the equation 1 thereto as it is. Unexplained reference numeral 25 denotes a service valve.

Figure 5:
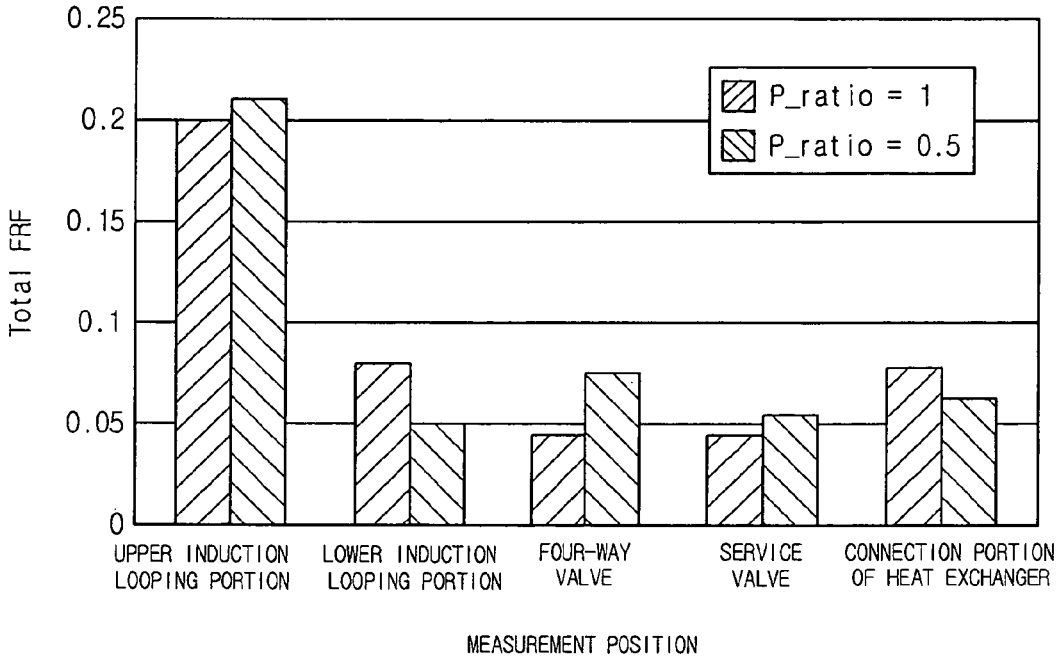
FIG. 5 is a graph showing vibrations measured at various points of the outdoor unit by applying the spirit of the present invention thereto.

FIG. 5 is a graph showing vibrations measured at various points of the outdoor unit by applying the spirit of the present invention thereto.

FIG. 5 is a frequency response function (FRF) for all frequencies at each point, in which a horizontal axis is a position of each point of the outdoor unit and a vertical axis is a value of vibration which may be quantitated by acceleration. That is to say, FIG. 5 is a figure showing the entire vibrations at a measurement point, which are generated in form of all frequencies by means of a predetermined vibration source, after quantitating them for the specific point.

Referring to FIG. 5, it is found that FRF is decreased particularly at a lower induction looping portion by changing P_ratio from 1 to 0.5. The point of the lower induction looping portion is positioned at an approximately center of the entire length of the induction pipe 11 or 21, and at that point, vibration is most greatly generated by means of resonance. Thus, the reduction of vibration at that point means that vibration and noise are reduced in the entire induction pipe. Seeing the figure, vibration at an upper induction looping portion is larger than vibrations at other portions. However, it is meaningless because such larger vibration is due to the fact that vibration of the compressor is intactly transferred to the induction pipe without loss since that portion is adjacent to the compressor. Thus, though the length of the induction pipe is increased or decreased by means of a predetermined relational expression, the vibration at that point is not changed so much.

As suggested in the figure, the overall vibration of the induction pipe 11 or 21 is decreased by changing P_ratio, so it is possible to reduce vibration and noise of the whole outdoor unit, which is objected by the present invention. As mentioned above, the reduction of vibration in the induction pipe is caused by the fact that the vibration, which is able to transferred to the induction pipe and then amplified by resonance of the induction pipe, is moved and dispersed to the four-way valve and other connection pipes connected to the four-way valve.

Figure 6:
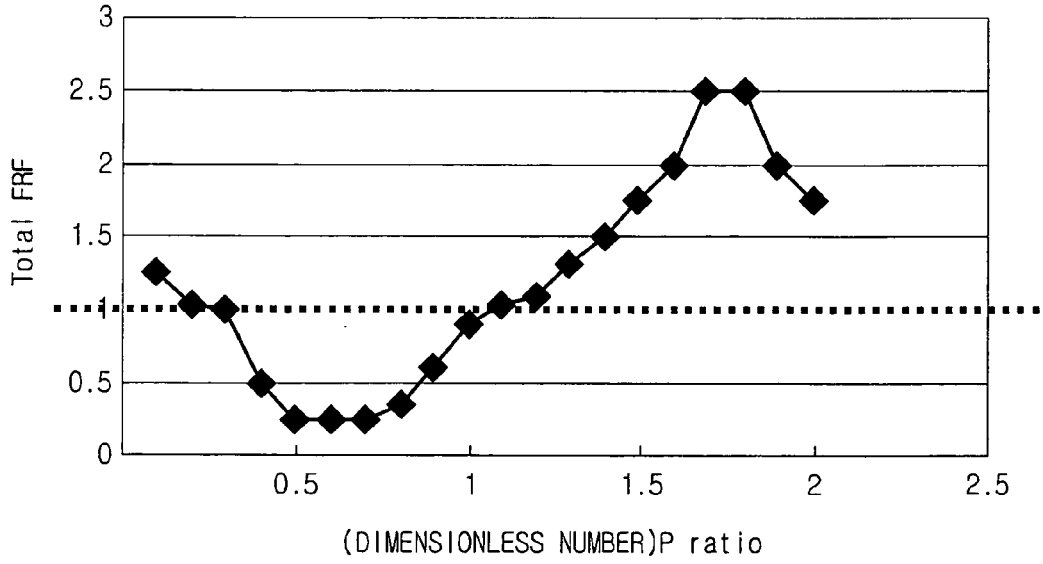
FIG. 6 is a graph showing vibrations generated in the entire outdoor unit with changing a length of an induction pipe in the present invention.

FIG. 6 is a graph showing vibrations generated in the entire outdoor unit with changing a length of the induction pipe according to the present invention. In FIG. 6, a horizontal axis is a changed amount of P_ratio, and a vertical axis is an overall frequency response function (FRF) for all frequencies, which means an amount of generated vibration, capable of being quantitated as an acceleration at a specific point according to the vibration.

Referring to FIG. 6, it is found that, a region having low vibration, in which FRF is less than 1 as P_ratio is changed, is coincident to the range of the equation 1. The preferable numerical range of P_ratio suggested by the equation 1 may be sufficiently supported by such experiments. In addition, in FIG. 6, when measuring vibration, points where vibration is greatest are selected in the outdoor unit for the measurement, so it may be concluded from such measurement result that the overall vibration of the outdoor unit is decreased.

The pipe structure described above may be applied to an outdoor unit of an air conditioner for cooling, an outdoor unit for a multi-type air conditioner, an outdoor unit for an air conditioner provided with an accumulator, and so on with suitable structural modification.

The pipe structure for an outdoor unit according to the present invention may reduce vibration concentrated on the induction pipe. In addition, it may reduce vibration/noise generated in the entire pipes connected to the compressor.

Furthermore, since inner configuration of the outdoor unit may become more compact, the outdoor unit may be made in a smaller size.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A pipe structure for use in an outdoor unit of an air conditioner including a compressor, an outdoor heat exchanger and an outdoor fan mounted in a case, the pine structure comprising:

a four-way valve for controlling flow of a coolant;

an outdoor connection pipe configured to be connected from the outdoor heat exchanger to the four-way valve;

an indoor connection pipe configured to be connected from the four-way valve to an indoor heat exchanger;

an induction pipe configured to be connected from the four-way valve to an induction portion of the compressor, the induction pipe having a length 0.3 to 1 times the sum of a length of the outdoor connection pipe and a length of the indoor connection pipe; and a discharge pipe configured to be connected from the four-way valve to a discharge portion of the compressor.

2. The pipe structure according to claim 1, wherein the compressor is a variable speed compressor.

3. The pipe structure according to claim 1, wherein the indoor connection pipe is configured to be connected to the four-way valve and to the case of the outdoor unit.

4. The pipe structure according to claim 1, wherein the indoor connection pipe is configured to be connected to the four-way valve and to a service valve.

5. The pipe structure according to claim 1, wherein the induction pipe is configured to be looped up and down.

6. The pipe structure according to claim 1, wherein the induction pipe is configured to be installed between the compressor and a barrier.

7. The pipe structure according to claim 1, wherein the induction pipe is configured to be installed between the compressor and the case of the outdoor unit.

8. The pipe structure according to claim 1, wherein the induction pipe is configured to extend from an approximately upper position of the compressor, then to bend at a lower portion of the compressor, and then to extend upward to the upper portion of the compressor.

9. The pipe structure according to claim 1, wherein the four-way valve is configured to be located at a position spaced apart from and above the compressor.

10. A pipe structure for an outdoor unit of an air conditioner, wherein the pipe structure satisfies the following equation:

$$1.0 > \frac{C}{A+B} > 0.3$$

where A is a length of an outdoor connection pipe connected from an outdoor heat exchanger to a four-way valve, B is a length of an indoor connection pipe connected from an indoor heat exchanger to the four-way valve, and C is a length of an induction pipe connected from the four-way valve to an induction portion of a compressor.

11. The pipe structure according to claim 10, wherein at least one loop is provided in the induction pipe in a longitudinal direction of the compressor.

12. The pipe structure according to claim 10, wherein the indoor connection pipe is configured to be connected from the four-way valve to a service valve of the outdoor unit.

13. The pipe structure according to claim 10, wherein the compressor is an inverter-controlled compressor.

14. The pipe structure according to claim 10, wherein cooling and heating operations of the air conditioner are switched by switching of the four-way valve.

15. A pipe structure for use in an outdoor unit of an air conditioner, the outdoor unit including an inverter-controlled compressor, the pipe structure comprising:

an induction pipe configured to be connected from an induction portion of the compressor to a four-way valve, at least one loop being provided in the induction pipe; and a connection pipe comprising:

an outdoor connection pipe that is configured to be connected from the four-way valve to an outdoor heat exchanger; and an indoor connection pipe that is configured to be connected from the four-way valve to an indoor heat exchanger, wherein the sum of a length of the outdoor connection pipe and a length of the indoor connection pipe configured to be longer than a length of the induction pipe.

16. The pipe structure according to claim 15, wherein the length of the induction pipe is configured to be at least 0.3 time of the length of the connection pipe.

17. The pipe structure according to claim 15, wherein an induction portion of the inverter-controlled compressor is provided in an approximately upper portion of the compressor.

18. The pipe structure according to claim 15, wherein the vibrations of the induction pipe are transferred to the four-way valve and then decreased.

19. The pipe structure according to claim 15, wherein the indoor connection pipe is connected from the four-way valve to a service valve.

20. The pipe structure according to claim 19, wherein the service valve is fixed to a case of an outdoor unit.

* * * * *

UNITED STATES PATENT AND TRADEMARK OFFICE

CERTIFICATE OF CORRECTION

PATENT NO. : 7,121,106 B2
APPLICATION NO. : 10/914087
DATED : October 17, 2006
INVENTOR(S) : Jung et al.

It is certified that error appears in the above-identified patent and that said Letters Patent is hereby corrected as shown below:

At column 6, line 63 (claim 1, line 3) of the printed patent, “pine” should be --pipe--.

Signed and Sealed this

Twentieth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,121,106 B2
APPLICATION NO. : 10/914087
DATED : October 17, 2006
INVENTOR(S) : Jung et al.

It is certified that error appears in the above-identified patent and that said Letters Patent is hereby corrected as shown below:

At column 6, line 63 (claim 1, line 3) of the printed patent, “pine” should be --pipe--.

Signed and Sealed this

Seventeenth Day of June, 2008

JON W. DUDAS
*Director of the United States Patent and Trademark Office*